US006386930B2

(12) United States Patent
Moffet

(10) Patent No.: US 6,386,930 B2
(45) Date of Patent: May 14, 2002

(54) DIFFERENTIAL BUCKET CONTROL SYSTEM FOR WATERJET BOATS

(75) Inventor: David W. Moffet, Newport, RI (US)

(73) Assignee: The Talaria Company, LLC, Boston, MA (US)

( * ) Notice: Subject to any disclaimer, the term of this patent is extended or adjusted under 35 U.S.C. 154(b) by 0 days.

(21) Appl. No.: 09/850,563

(22) Filed: May 7, 2001

Related U.S. Application Data

(63) Continuation of application No. 09/544,861, filed on Apr. 7, 2000, now abandoned, and a continuation of application No. PCT/US01/11483, filed on Apr. 9, 2001.

(51) Int. Cl.[7] ..... B63H 11/11

(52) U.S. Cl. ..... 440/41; 440/42; 114/144 E

(58) Field of Search ..... 440/41–43, 40; 114/144 R, 144 E

(56) References Cited

U.S. PATENT DOCUMENTS

| | | | | |
|---|---|---|---|---|
| 3,918,256 | A | 11/1975 | Ashleman | 60/221 |
| 3,937,172 | A | 2/1976 | Castoldi | 115/12 R |
| 3,942,464 | A | 3/1976 | Schoell | 115/12 R |
| 3,976,023 | A | 8/1976 | Noguchi et al. | 114/144 E |
| 4,026,235 | A | 5/1977 | Woodfill | 115/12 R |
| 4,047,494 | A | 9/1977 | Scott | 115/12 R |
| 4,073,258 | A | 2/1978 | Logan | 115/12 R |
| 4,214,544 | A | 7/1980 | Dashew et al. | 114/151 |
| 4,220,111 | A | 9/1980 | Krautkremer et al. | 440/53 |
| 4,223,630 | A | 9/1980 | Kenney | 440/41 |
| 4,417,879 | A | 11/1983 | Kulischenko | 440/62 |
| 4,509,923 | A | 4/1985 | Turnbull | 440/43 |
| 4,519,335 | A | 5/1985 | Krautkremer et al. | 114/144 R |
| 4,691,659 | A | 9/1987 | Ito et al. | 114/144 R |
| 4,747,359 | A | 5/1988 | Ueno | 114/144 B |
| 4,748,928 | A | 6/1988 | Nakamura | 114/144 R |
| 4,915,049 | A | 4/1990 | Nakamura | 114/144 R |
| 4,962,717 | A | 10/1990 | Tsumiyama | 114/144 R |
| 4,992,065 | A | 2/1991 | Torneman et al. | 440/41 |
| 4,996,937 | A | 3/1991 | Niina et al. | 114/144 R |
| 5,031,561 | A | 7/1991 | Nilsson | 114/144 R |
| 5,050,518 | A | 9/1991 | Okita | 114/144 A |
| 5,090,929 | A | 2/1992 | Rieben | 440/40 |
| 5,107,424 | A | 4/1992 | Bird et al. | 364/424.01 |
| 5,129,846 | A | 7/1992 | Dimijian | 440/40 |

(List continued on next page.)

FOREIGN PATENT DOCUMENTS

| | | |
|---|---|---|
| EP | 0035859 | 9/1981 |
| JP | 406024388 A | 2/1994 |

OTHER PUBLICATIONS

SERVO COMMANDER—Single Drive Brochure, SKT/Styr–KontrollTeknik AB; BN Marin Elektronik, Sweden (1996).

SERVO COMMANDER—Dual Drive Brochure, SKT/Styr–KontrollTeknik AB; BN Marin Elektronik, Sweden (1996).

Atlantic Control Systems, Inc. Jetstic Dual Drive System.

*Primary Examiner*—Sherman Basinger
(74) *Attorney, Agent, or Firm*—Fish & Richardson P.C.

(57) ABSTRACT

A waterjet-driven boat has a reversing bucket for controlling forward/reverse thrust and a rotatable nozzle for controlling sideward forces. A bucket position sensor is connected to the reversing bucket, and the bucket is controlled using the output of the position sensor to enable the bucket to be automatically moved to a neutral thrust position. Similarly, a nozzle position sensor is connected to the nozzle, and the nozzle is controlled using the output of the nozzle position sensor so that the nozzle may be automatically returned to a zero sideward force position. A joystick with two axes of motion may be used to control both the bucket and the nozzle. The joystick has built-in centering forces that automatically return it to a neutral position, causing both the bucket and nozzle to return to their neutral positions.

17 Claims, 11 Drawing Sheets

U.S. PATENT DOCUMENTS

| | | | | |
|---|---|---|---|---|
| 5,235,927 | A | 8/1993 | Singh et al. | 114/144 E |
| 5,240,444 | A | 8/1993 | Kobayashi et al. | 440/41 |
| 5,344,344 | A | 9/1994 | Forsstrom | 440/41 |
| 5,361,717 | A | 11/1994 | Kobayashi | 114/361 |
| 5,362,269 | A | 11/1994 | Leach | 441/65 |
| 5,395,272 | A | 3/1995 | Smith | 440/42 |
| 5,540,174 | A | 7/1996 | Kishi et al. | 114/291 |
| 5,603,644 | A | 2/1997 | Kobayashi et al. | 440/86 |
| 5,664,978 | A | 9/1997 | Howe | 440/75 |
| 5,707,264 | A | 1/1998 | Kobayashi et al. | 440/86 |
| 6,230,642 | B1 * | 5/2001 | McKenney et al. | 114/150 |
| 6,234,100 | B1 * | 5/2001 | Fadeley et al. | 114/144 R |
| 6,234,853 | B1 * | 5/2001 | Lanyi et al. | 440/53 |

* cited by examiner

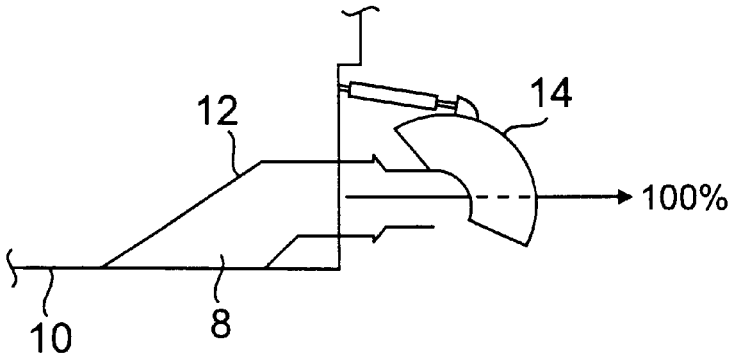
FIG. 2A
PRIOR ART
FIG. 2B
PRIOR ART
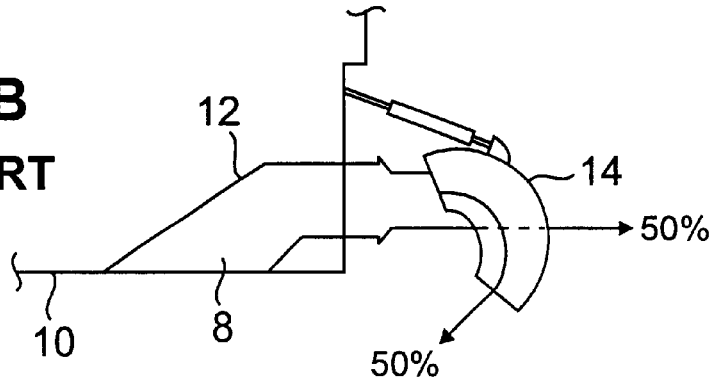
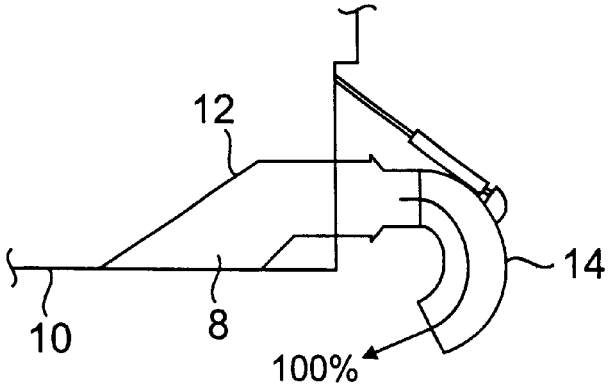
FIG. 2C
PRIOR ART

OPERATION MODES

DOCKING MODE

- CONTROLS NOZZLE
- CONTROLS REVERSING BUCKETS W/ FOLLOW-UP
- PROVIDES DIFFERENTIAL BUCKET CONTROL

POWER STEERING MODE

- CONTROLS NOZZLE
- CONTROLS REVERSING BUCKETS W/ NON FOLLOW-UP

HELM MODE

- CONTROLS REVERSING BUCKETS W/ NON FOLLOW-UP

DIFFERENTIAL BUCKET CONTROL SYSTEM FOR WATERJET BOATS

CROSS-REFERENCE TO RELATED APPLICATIONS

This application is a continuation application of and claims priority to U.S. application Ser. No. 09/544,861, filed on Apr. 7, 2000, now abandoned, and PCT Application Ser. No. US01/11483, filed on Apr. 9, 2001.

BACKGROUND OF THE INVENTION

The invention relates to steering and thrust control systems for waterjet driven boats.

With a waterjet drive, seawater is drawn in through the bottom of the boat and ejected in a stream out the back. The reaction to this movement of water is the propulsive force that moves the boat. Near the back of the stream is a nozzle, which serves two functions. It accelerates the stream by reducing its diameter, and it can be turned from side to side to deflect the exiting stream to apply a component of side force on the aft part of the boat. The nozzle is to a jet what a rudder is to a boat equipped with conventional propellers. Both are typically connected to a steering wheel.

The aftmost portion of the jet, just behind the nozzle, is a device called a reversing bucket. Its function is to allow the operator to reverse some or all of the stream in order to stop or back up the boat. In normal underway operation the bucket is elevated above the stream and has no effect. When reduced forward thrust is desired the bucket can be lowered into the stream, forcing a portion of the flow through curved channels until it exits in a forward and slightly downward direction. When roughly half the stream is still streaming aft below the bucket and half is being reversed to a more forward direction (the neutral bucket position), an approximate balance point can be reached that results in approximately no forward or aft thrust on the boat. If the bucket is lowered to the full down position, nearly all the thrust is reversed and the boat should begin moving in reverse. The particular design of some reverse buckets (e.g., Hamilton waterjets), and the way the bucket interacts with the nozzle, permits a net thrust in any direction in the plane of the water's surface. Side to side force is adjusted by nozzle position, and forward or aft force by bucket position.

A waterjet is either engaged and pumping water or disengaged and not pumping water. It does not ordinarily have a forward and reverse in the same manner as a conventional propeller. A transmission with reverse gear can be provided as a means of allowing the engine to run without engaging the jet and to allow for backflushing that results from reversing the drive shaft to the jet to clear an obstruction that may have been drawn against the jet inlet. Actual reverse thrust is accomplished with the jet engaged in the forward direction and the bucket lowered, similar in concept to the reversing arrangement on aviation jet engines.

Waterjet drives have numerous advantages, e.g., low draft, reduced noise, improved high-speed maneuverability. But they can make a boat difficult to control at slow speeds in tight quarters (e.g., when docking). The reason for this is that, heretofore, there has been no simple way to achieve zero thrust or zero side force. In a conventionally powered boat, zero thrust and zero side force are easily achieved, simply by putting the transmission into neutral, thereby bringing the propeller to rest. But with a waterjet, the only way to achieve zero thrust is to move the bucket to a position at which the net of the forward and reverse portions of the jet is balanced. That position can only be chosen approximately. It takes considerable training and experience for an operator to acquire a sense of what the waterjet drive is doing, to allow successful slow speed operation.

Waterjet drives also behave differently in reverse from propeller driven craft. Because the flow of water through the jet is always in one direction, deflection of the stream results in the same sideward force regardless of whether the boat is moving forward or in reverse. This is in contrast to a conventional rudder, whose effect on the stern of a boat is reversed depending on the direction of travel through the water. This difference in steering in reverse presents difficulties for new operators, who anticipate that steering direction will change when the boat is backing up.

To control movement of the bow of a boat, some boats are equipped with bow thrusters. Such a thruster is often installed in a tube that runs from side to side at the bow below the waterline. In the middle of this tube is a propeller that can thrust either way by reversing rotation. In smaller boats, this propeller is usually driven by an electric motor. The combination of waterjet and bow thruster can give a boat extraordinary maneuverability. Movement in any direction in the plane of the water's surface is possible, even directly sideways. But, unfortunately, the operator is typically required to skillfully coordinate different controls simultaneously to take full advantage of this maneuverability. E.g., a foot pedal or left/right deflection of a hand-operated lever may be used to control the bow thruster, a steering wheel, to control the rear nozzle, and a throttle lever, to control speed.

Some boats with twin Hamilton waterjet drives (e.g., Little Harbor Whisperjet boats) have been operated with the reversing buckets manually set at different positions (by adjustment of the separate bucket-position control for each bucket), to effect a sideward force on the stern.

The Hinckley Company has sold boats with a single waterjet drive (e.g., the Picnic Boat) with a joystick that combines control of bucket position, nozzle, and bow thruster. This control system is described in U.S. Pat. No. 6,234,100, filed on Sep. 3, 1998. The same control system has been applied to the Hinckley Talaria 44 twin waterjet boat, by ganging the two position, and similarly the nozzles of both jets are always at the same angle.

Some large twin waterjet boats have used differential control of the nozzles to achieve a sideward force on the boat. The technique is described in U.S. Pat. No. 5,031,561.

SUMMARY OF THE INVENTION

We have discovered an improved method for controlling waterjet drive boats in which there are at least two waterjet drives. Each of three different directions of movement of a stick control member is used to control one of three movements of the waterjet drives: (1) up/down movement of the buckets in unison, to produce the forward and reserve thrust; (2) rotation of the nozzles, to produce left and right sideward forces on the stern; (3) differential movement of the buckets, to produce a torque about a generally vertical axis to move the bow of the boat to the left or right.

One or more of the following features may be incorporated in preferred embodiments of the invention.

The nozzles are configured to rotate in unison in response to movement of the stick control member in the second direction.

The first direction of movement of the stick control member is fore and aft movement of the member, and the control circuit is configured so that movement of the stick control member forward from a neutral position moves the buckets in unison toward a forward thrust position, and movement of the stick control member rearward from a neutral position moves the buckets in unison toward a reverse thrust position.

The second direction of movement of the stick control member is rotation about a generally vertical axis, and the control circuit is configured so that rotation of the stick control member produces rotation of the nozzles in unison and the left or right sideward forces on the stern.

The third direction of movement of the stick control member is left and right sideward movement, and the control circuitry is configured so that leftward movement of the stick control member produces rotation of the boat about a vertical axis in a direction that produces leftward movement of the bow of the boat, and rightward movement of the stick control member products rotation of the boat about a vertical axis in a direction that produces rightward movement of the bow of the boat.

The stick control member and control circuit are configured to provide at least two modes of operation, a first mode in which a followup relationship exists between forward/aft movement of the stick control member, and up/down unison movements of the reversing buckets, and a second mode in which a non-followup relationship exists between forward/aft movement of the stick control member and up/down unison movements of the reversing buckets.

The stick control member and control circuit are configured to provide a follow-up relationship between the rotation of the stick control member and rotation of the nozzles.

The control circuit is configured to provide both a docking mode and a power steer mode of operation. In the docking mode of operation, the reversing buckets control and the nozzles have a follow-up relationship to the respective movements of the stick control member. In the power steer mode of operation, the reversing buckets have a non-followup relationship and the nozzles have a followup relationship to the respective movements of the stick control member.

The boat is 75 feet or under in length.

The stick control member and control circuit are configured, so that in at least one mode of operation, when the operator releases the stick member it returns to a neutral position and all forward and reverse forces, all sideward forces on the stern, and all torque about a vertical axis are brought substantially to zero.

Other features and advantages of the invention will be apparent from the following description of preferred embodiments, and from the claims.

BRIEF DESCRIPTION OF THE DRAWINGS

FIGS. 2A, 2B, and 2C are enlarged, diagrammatic, elevation views of the waterjet and reversing bucket of FIG. 1A, showing the bucket in three different positions.

FIGS. 3A–3C) and all of the way down (maximum reverse thrust; FIGS. 3D–F) and differential bucket modes (FIGS. 3G–3K). The joystick is referred to as the jetstick in some places in the drawings. These terms are used interchangeably in the application.

DESCRIPTION OF THE PREFERRED EMBODIMENTS

Figure 1A:
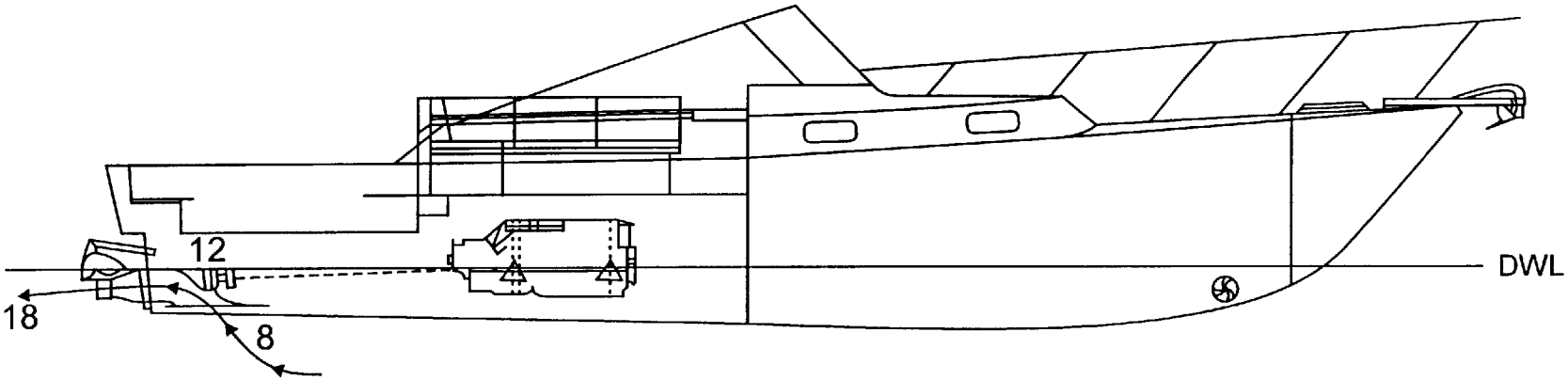
FIG. 1A is an elevation view of a boat equipped with twin waterjet drives.
Figure 1B:
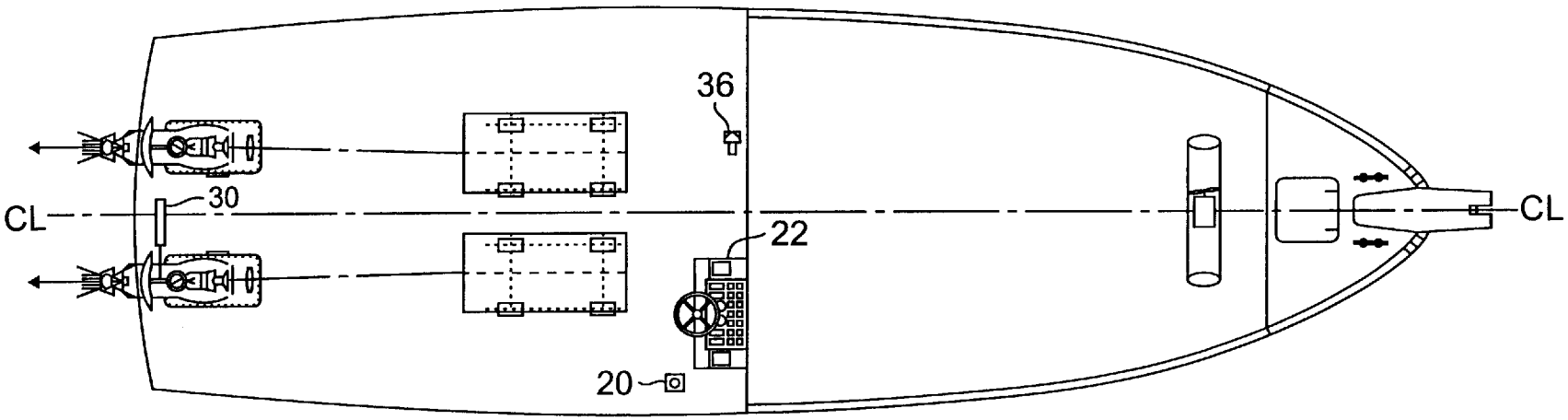
FIG. 1B is a plan view of the same boat.

A boat 10 with twin waterjet drives 12 is shown in FIGS. 1A and 1B. Water enters the drive through inlet 8, and exits through nozzle 18.

FIGS. 2A–2C are enlarged views of the waterjet drive 12, showing the reversing bucket 14 in full forward (FIG. 2A), approximately neutral (FIG. 2B), and full reverse (FIG. 2C) positions.

FIGS. 3A–3K are diagrammatic views showing the joystick position and corresponding positions of the bucket and nozzle of each waterjet.

Figure 3A:
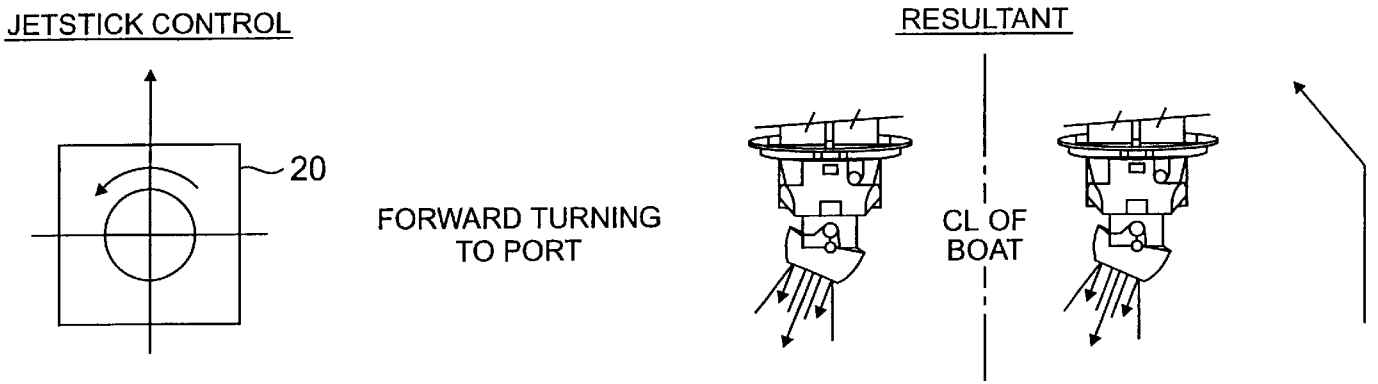
FIGS. 3A–3K are enlarged, diagrammatic, plan views of the waterjets and reversing buckets of FIG. 1B, showing the nozzle in the different positions in relation to the joystick movement about its 3 axes for the case of the reversing bucket being all of the way up (maximum forward thrust.
Figure 3B:
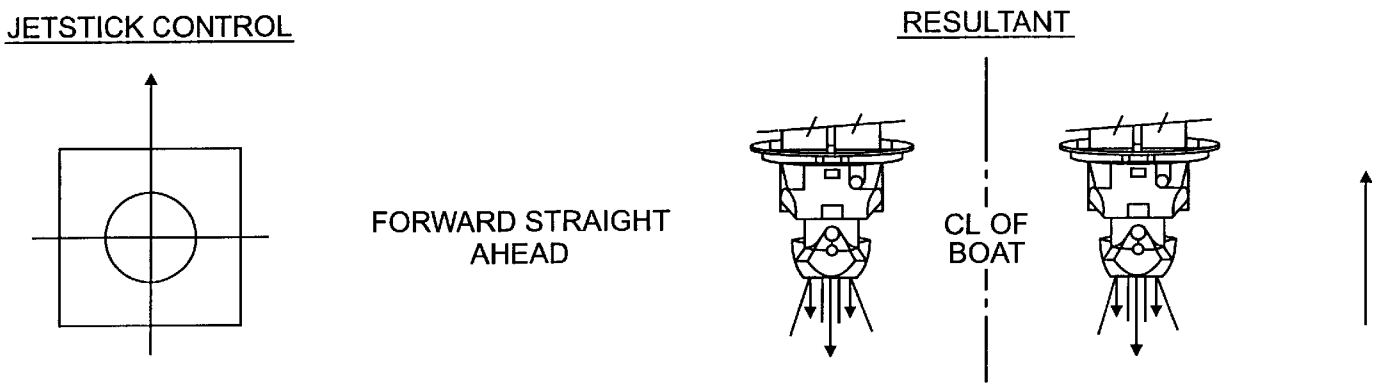
Figure 3C:
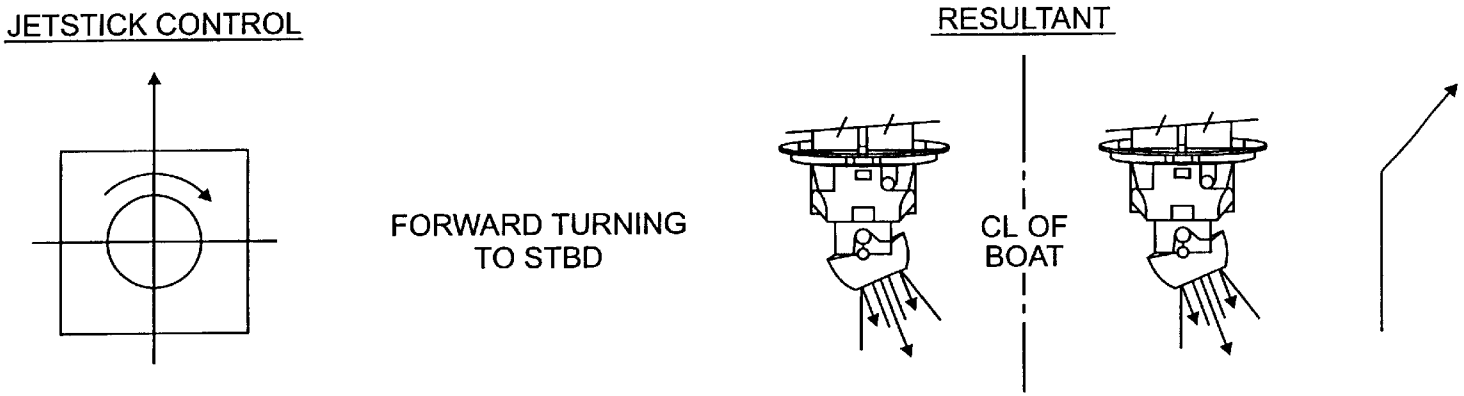

FIGS. 3A–3C show the waterjet nozzles in three different angular positions (the nozzles rotate in unison about a generally vertical axis) for the case in which the reversing bucket is all of the way up: port sideways thrust (FIG. 3A), approximately neutral thrust (FIG. 3B), and starboard sideways thrust (FIG. 3C). When the bucket is all of the way up, the bucket is out of the way of the nozzle, and thus does not show up in FIGS. 3A–3C. Nozzle thrust is predominantly directed rearwardly, but a sideward component of thrust is provided when the nozzle is angled to the port (FIG. 3A) or starboard (FIG. 3C).

Figure 3D:
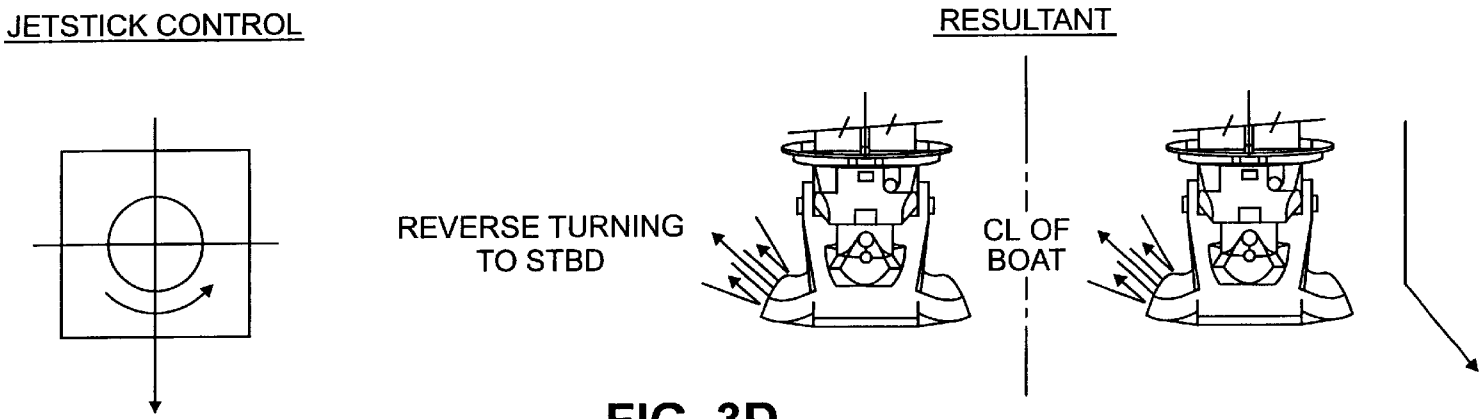
Figure 3E:
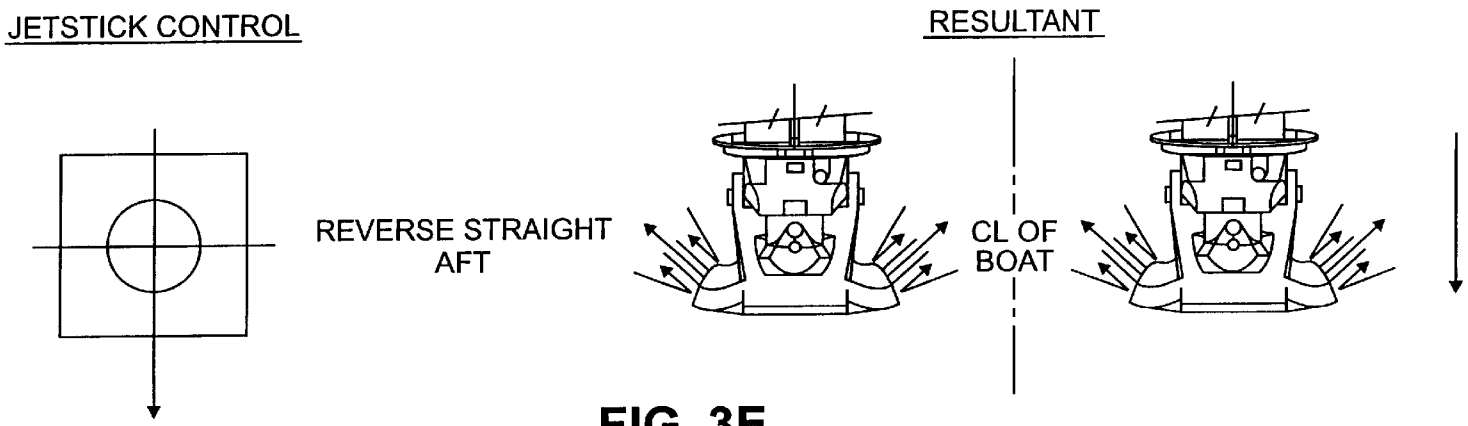
Figure 3F:
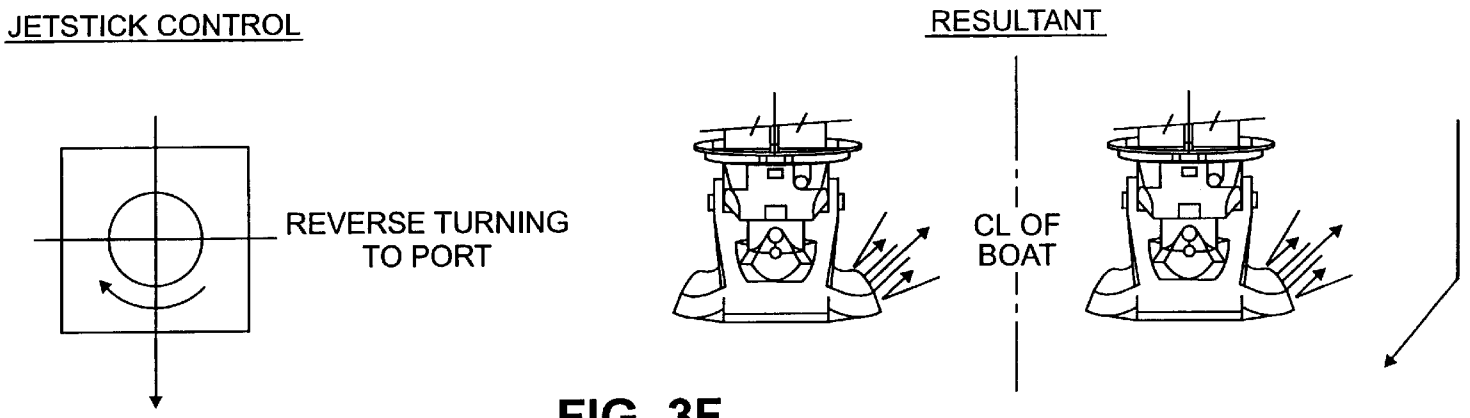

FIGS. 3D–3F show the waterjet nozzles in the same three angular positions for the case in which the reversing bucket is fully down. The bucket has the effect of reversing the dominant thrust direction, but the sideward component of thrust is approximately the same as if the bucket were all of the way up (e.g., the sideward component is approximately the same in FIGS. 3A and 3D, and in 3C and 3F).

Figure 3G:
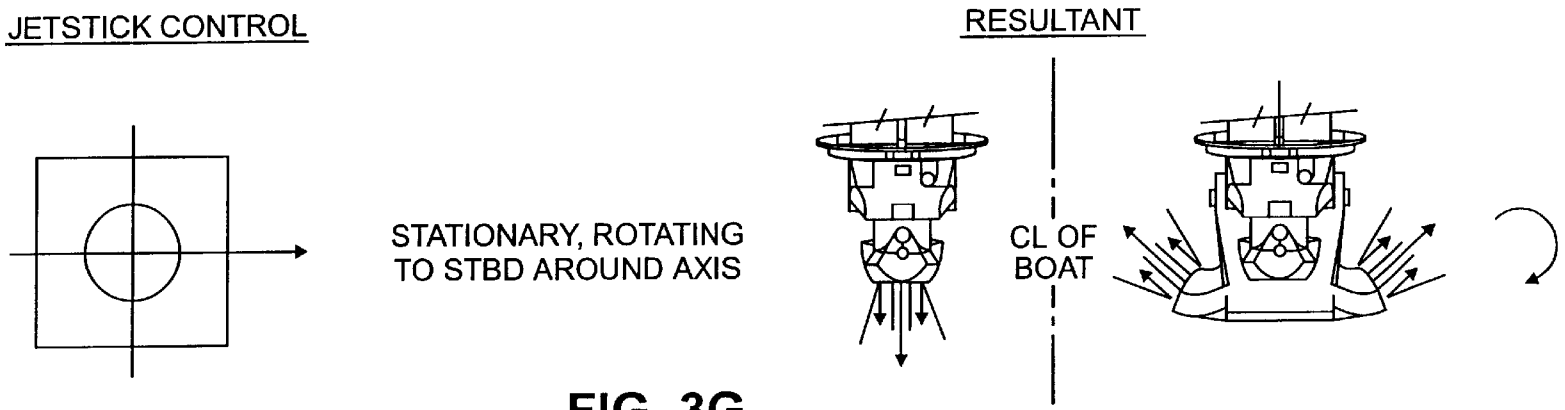
Figure 3H:
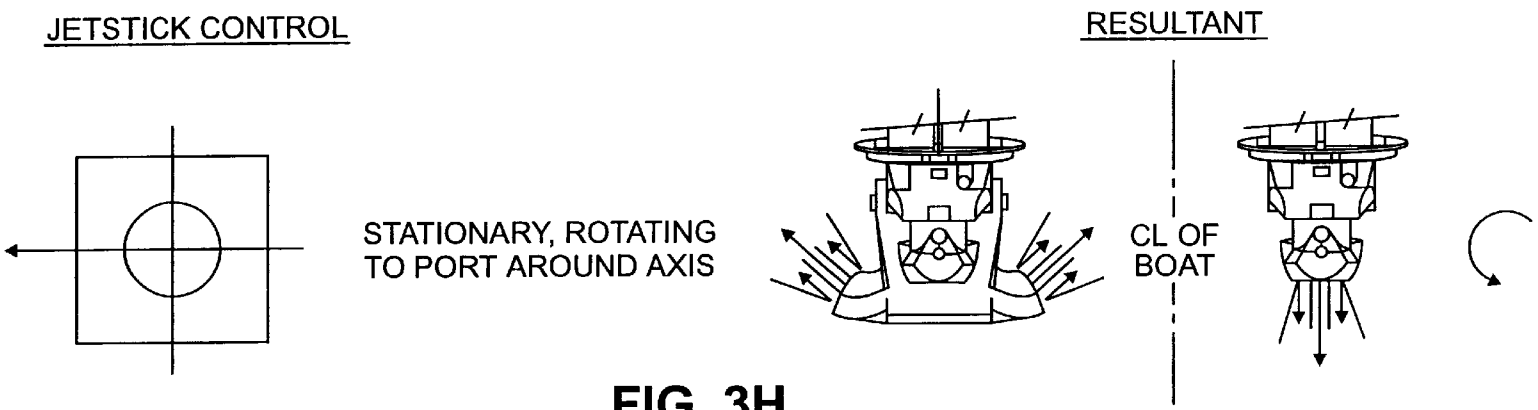
Figure 3I:
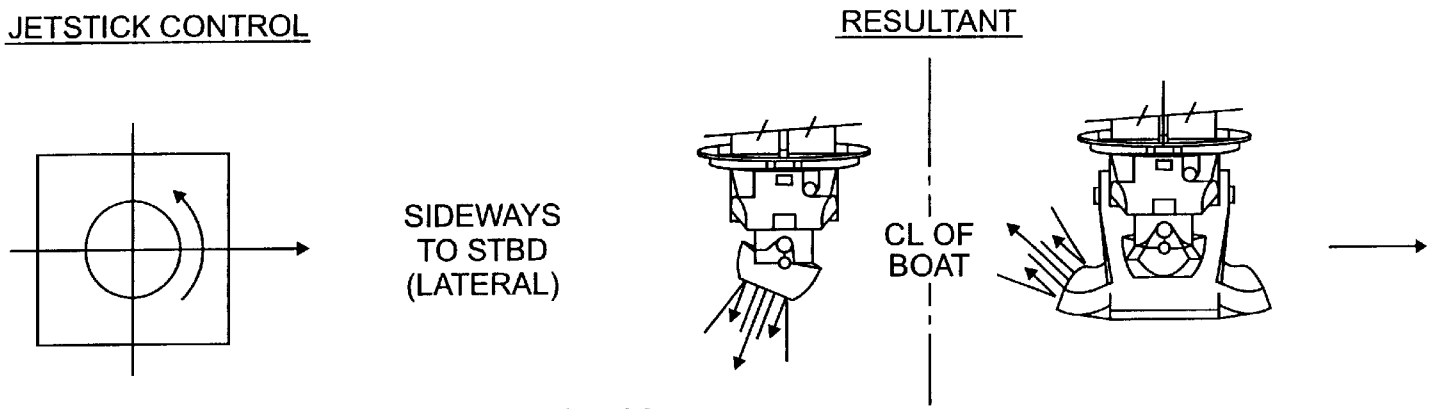
Figure 3J:
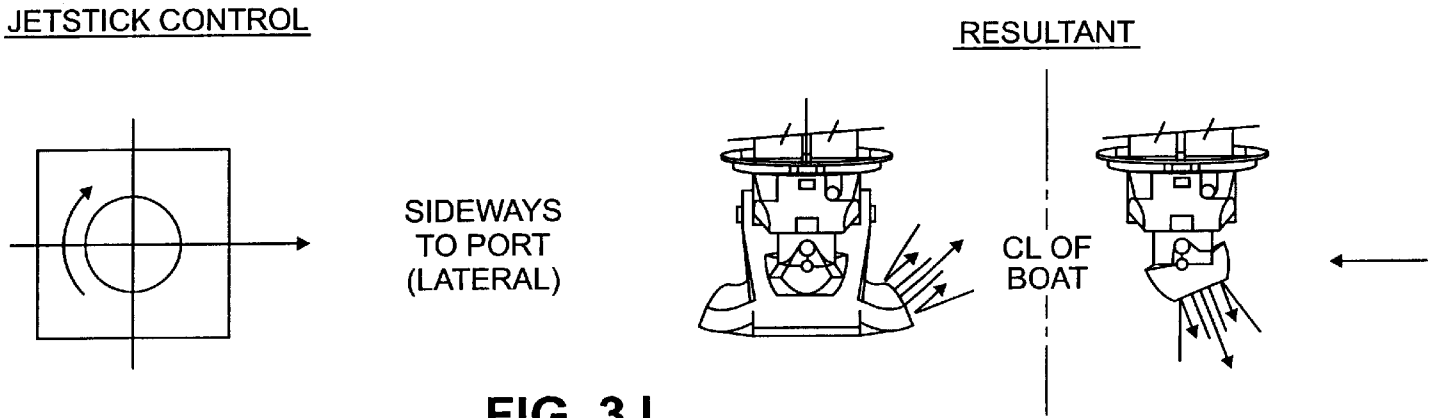

FIGS. 3G–3J show the waterjet nozzle with the effects of differential bucket placement. In FIGS. 3G and 3H with the nozzle neutralized when the reversing buckets are differentiated the fore and aft thrust is also differentiated around the central axis of the boat and the overall effect is to rotate the boat around its own "x" axis. In FIGS. 3I and 3J with the reversing buckets differentiated the nozzle is then moved into an angular position to counteract the rotation of the boat around its "x" axis. The overall effect of the resulting thrust vectors is to move the boat laterally (sideways) to port (left) or starboard (right) perpendicular to its fore and aft axis.

If either 3I and 3J fore and aft movement needs to be controlled due to outside forces or the need to move forward or aft while moving laterally the forward or reverse thrust can be reduced by moving the reverse buckets in unison while maintaining their differential position relative to each other. When one bucket reaches its end stop the other will continue on until it reaches its own end stop.

Figure 3K:
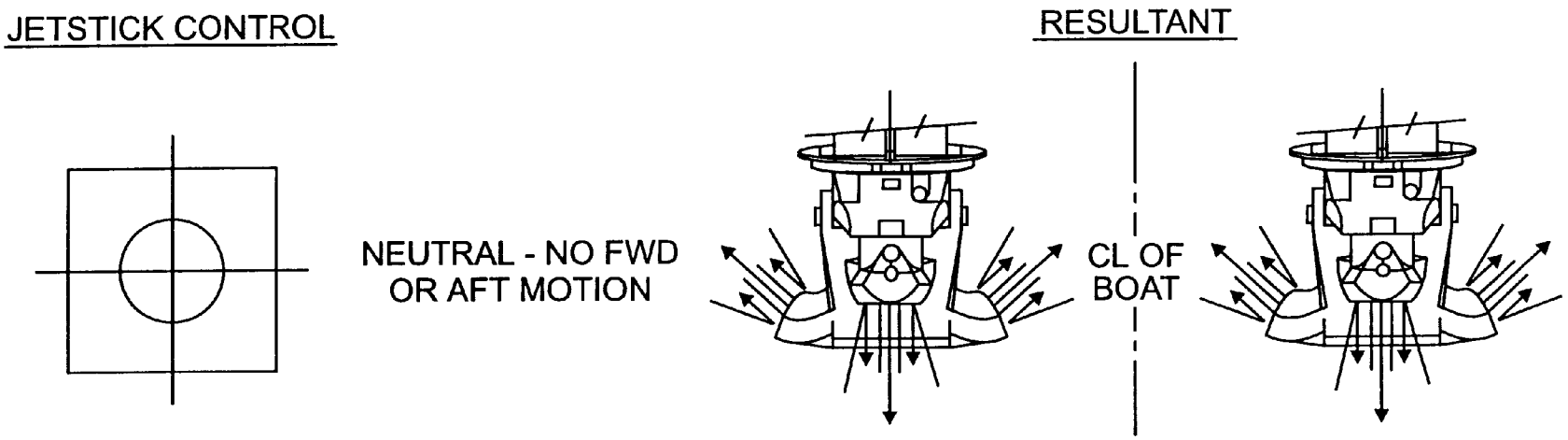

FIG. 3K shows the buckets and nozzles neutralized to produce a resultant thrust that is neutral, maintaining the boat stationary.

Electrical and Hydraulic Components

Figure 4:
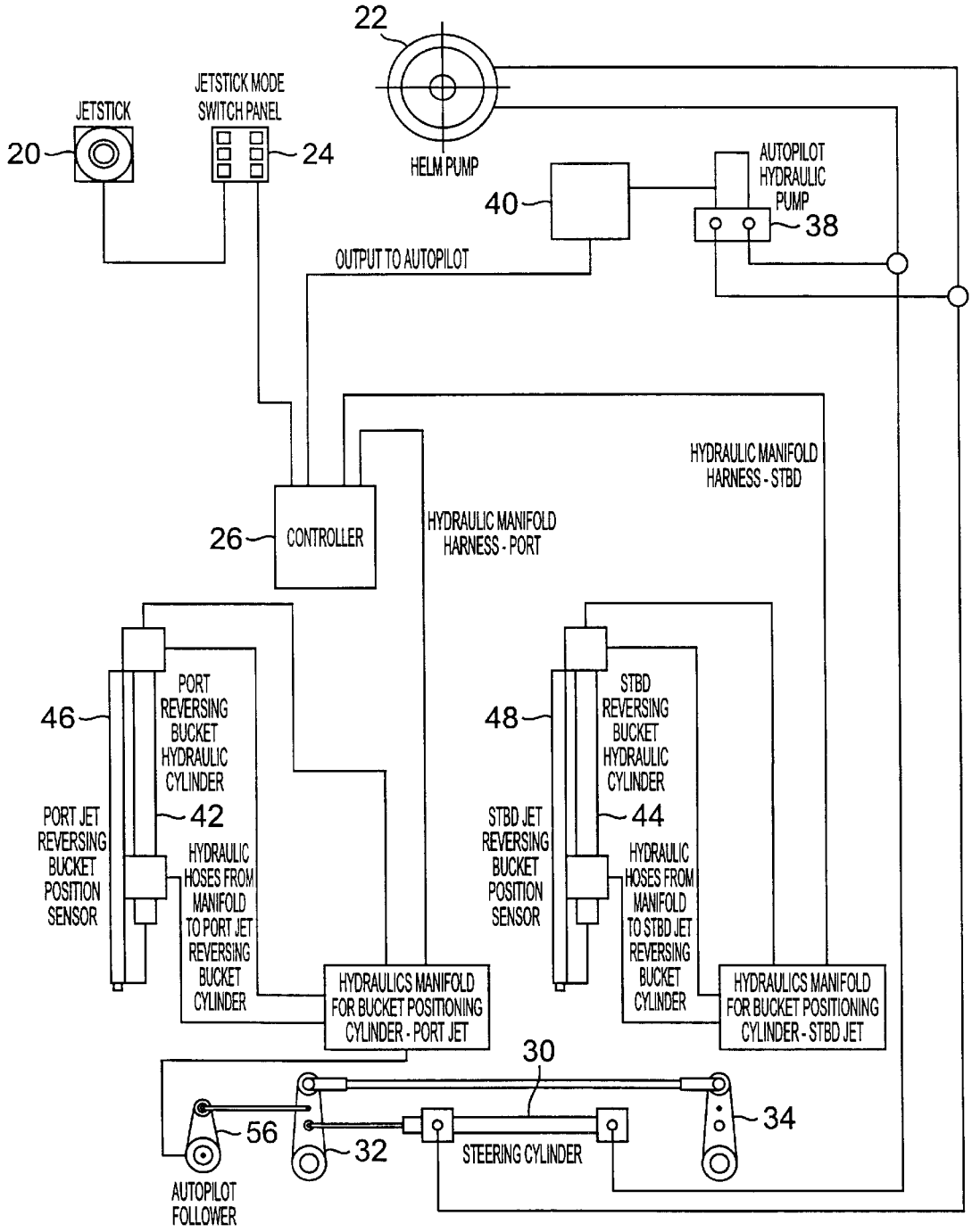
FIG. 4 is an overall electrical and hydraulic schematic of a preferred embodiment of the invention.

FIG. 4 shows the principal electrical and hydraulic components of a preferred embodiment. Operator control of the steering nozzles and reversing buckets is achieved using a joystick 20 and steering wheel 22. The joystick 20 has three independent directions of movement: rotating or twisting movement about a vertical axis, for control of the steering nozzles in unison; forward/aft movement, for control of the reversing buckets in unison; left/right (port/starboard) movement, for differential control of the reversing buckets. In each direction of movement, a centering force (or torque, in the case of rotation) returns the joystick to a neutral, centered position when it is released.

A mode selection switchpanel 24 is used by the operator to vary the relationship between movements of the joystick and movements of the steering nozzles and reversing buckets. The operator can select from among three modes: Helm, Docking, and Power Steer. Outputs from switchpanel 24 are fed to the controller 26. A small trim knob is used to offset the center position of the nozzle in the Power Steer mode (it is connected to a 270 degree potentiometer).

The controller is housed in an electronics enclosure. All other components in the system connect to the controller, including joystick, switchpanel 24, power supply leads, bucket and nozzle feedbacks and autopilot output. Cables lead from the controller to bucket actuators 42, 44, position sensors 46, 48, and nozzle position sensor 56. The position sensors are sealed linear (bucket) and rotary (nozzle) potentiometers. These are preferably mounted so that they are in the middle of their travel at neutral bucket and nozzle, as this allows calibration of neutral bucket and neutral nozzle positions by simply loosening the position sensor brackets and rotating the sensors. In the case of smaller jets with internal hydraulic directional control valves, linear actuators with internal potentiometers are used to control bucket positioning.

Operation

Figure 5:
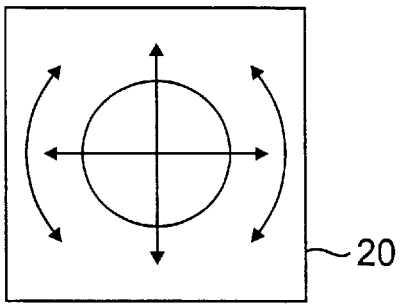
FIG. 5 is a diagrammatic view showing three modes of operation.
Figure 5:
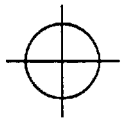
Figure 5:
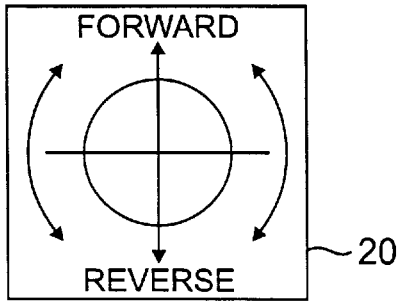
Figure 5:
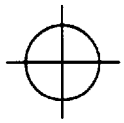
Figure 5:
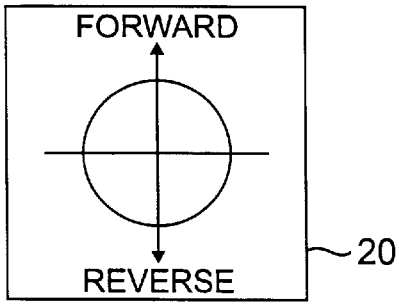
Figure 5:
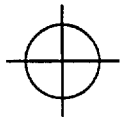

As noted earlier, three modes of operation are available, selected by pressing buttons on the switchpanel: Helm, Docking, and Power Steer (as shown in FIG. 5). The primary difference between modes is the method of controlling bucket and nozzle.

1. Helm Mode

Helm is the default mode, which the system is in when power is first supplied to the controller. In Helm mode, the boat is steered solely by the steering wheel (in conjunction with the autopilot, if activated), and is the mode typically used underway when the boat operator prefers to steer with the wheel. Helm mode also serves as the failsafe mode in the event of a failure of the joystick or controller. The steering wheel is connected hydraulically (in a conventional manner) to steering ram 30, which drives tiller arms 32, 34 which are mechanically coupled to the waterjet nozzles.

In Helm mode the reversing bucket functions in a non-follow-up manner, i.e., forward or aft movement of the joystick functions as a simple up/down directional switch for movement of the bucket. Forward movement of the joystick causes the bucket to move upward as long as the joystick is held forward of center. Conversely, aft movement causes the bucket to move downwardly for as long as the joystick is held aft of center. When the joystick is at rest, i.e., in the neutral center position, the bucket remains at its current orientation. Thus, tapping the joystick forward or aft momentarily in Helm mode causes the bucket to move incrementally upward or downward by a small amount and then remain in that position.

2. Docking Mode

Docking mode is the mode used for slow speed maneuvering, e.g., in approaching a dock or slip. In this mode, both buckets and nozzles are controlled by the joystick in a follow-up manner. Thus, moving the joystick to a position (e.g., halfway forward) causes the corresponding device (e.g., the buckets) to move to a corresponding position (e.g., halfway up).

In Docking mode, twisting of the joystick produces rotation of the nozzle. Twisting the joystick produces an output signal that is compared to the output of position sensor 56, which measures the position of the nozzles. The comparison produces speed and direction signals which for use by the autopilot 40, which controls autopilot pump 38. The result is that the nozzles move for use by until the output of position sensor matches the joystick output signal. For example, if the joystick is twisted to the right from a neutral position, there is initially a large difference in voltage between the joystick output and the output of the tiller position signal. This produces a movement of the nozzles in a direction that causes the stern of the boat to move to port (left). As the nozzles turn, the output of the tiller position signal increases until a point is reached at which the amplitude of the position sensor signal matches that of the joystick signal, at which point movement of the nozzles ceases. Bucket control in docking mode is also done in a follow up manner. Fore and aft movement of the joystick results in the reversing buckets moving up and down until the output of the position sensor matches the output of the joystick potentiometer. The signal from the controller is sent either to a hydraulics manifold with directional control valves or a linear actuator with integral potentiometer. When the joystick is released and returns to the neutral position the reversing buckets follow up to the neutral position.

Left/right (port/starboard) movement of the joystick controls the differential positioning of the reversing buckets such that a leftward movement of the joystick causes the port bucket to move down and the starboard bucket to move up resulting in the bow moving the port around a vertical axis passing between the two waterjets. Movement of the joystick to starboard causes the starboard bucket to move down and the port bucket to move up resulting in the bow moving to starboard around that vertical axis. The farther the joystick is moved left or right away from the neutral position the greater the differential between the bucket positions and the greater the side force created. Use of the differential bucket control will provide for quick turning of the boat in tight quarters.

When the differential bucket controls are used in conjunction with the joystick steering nozzle control the boat can be moved laterally (sideways) perpendicular to the boats centerline axis. A leftward movement of the joystick combined with a righthand rotation (twist) of the joystick will produce a leftward (port) lateral (sideways) movement. A righthand movement of the joystick combined with a lefthand (twist) of the joystick will produce a righthand (starboard) lateral (sideways) movement.

When fore and aft control is also required at the same time as a lateral movement a forward movement of the joystick will move both buckets up in unison at the same rate until the raised bucket reaches the full up position, at which point the lowered bucket will continue to move up.

The opposite would be true when reverse movement is required.

3. Power Steer Mode

The third mode of operation is the Power Steer mode, in which the boat operator steers underway using the joystick rather than the wheel. Bucket control is the same as in Helm mode, i.e., non-follow-up (the joystick works as a up/down switch to control the reversing bucket). Nozzle control is similar to Docking mode, except that a trim circuit is activated by control output. The trim circuit reduces the sensitivity of the joystick, so that the same degree of twist in Power Steer produces less nozzle movement than in Docking. Also, a trim potentiometer on the control panel is activated, allowing the operator to adjust the nozzle position that corresponds to zero twist of the joystick. This allows the operator to make small adjustments to the boat's track, e.g., to compensate for the effect of crosswind or current (without requiring that the operator maintain a slight twist on the joystick).

Left/right (port/starboard) movement of the joystick for differential reversing bucket control is discontinued in Power Steer mode as this is only required in low speed docking.

Other embodiments are within the scope of the following claims.

What is claimed is:

1. A boat of the type driven by at least two waterjets, the boat comprising:

at least two waterjet drive assemblies, each assembly comprising:

a nozzle at the stern of the boat, the nozzle directing a flow of water generally along the longitudinal direction, the nozzle being capable of rotation about a generally vertical axis to provide left and right sideward forces on the stern;

a reversing bucket for reversing the direction of a variable amount of the flow of water emerging from the nozzle, the reversing bucket being adjustable from any of a plurality of forward thrust positions in which enough water remains sufficiently unaffected by the reversing bucket that a net forward thrust is maintained, to a neutral thrust position in which a substantial fraction of the flow of water is reversed so that the net thrust of the water reversed and the water not reversed is approximately zero, to any of a plurality of reverse thrust positions in which enough water is reversed that a net reverse thrust is maintained;

actuators for producing movement of the nozzles and reversing buckets;

a control circuit for controlling the actuators the control circuit, actuators, and waterjet drive assemblies being configured to provide three types of movements of the nozzles and reversing buckets: (1) movement of the buckets in unison, to produce the forward and reserve thrust; (2) rotation of the nozzles in unison to provide the left and right sideward forces on the stern, (3) differential movement of the buckets, to produce a torque about a generally vertical axis to move the bow of the boat to the left or right; and a joystick device connected electrically to the control circuit, and configured to control movement of the reversing buckets in unison, rotation of the nozzles in unison, and differential movement of the buckets.

2. The boat of claim 1 wherein the joystick device has a stick control member capable of first, second, and third movements.

3. The boat of claim 2 wherein at least one of the movements of the stick control member is fore and aft movements of the stick control member.

4. The boat of claim 2 wherein at least one of the movements of the stick control member is left and right movement of the stick control member.

5. The boat of claim 2 wherein at least one of the movements of the stick control member is rotation of the stick control member.

6. The boat of claim 2 wherein one of the movements of the stick control member is fore and aft movement of the stick control member, and a second movement is left and right movement of the stick control member.

7. The boat of claim 2 wherein one of the movements of the stick control member is fore and aft movement of the stick control member, and a second is left and right movement of the stick control member, and a third is rotation of the stick control member.

8. The boat of claims 3, 6, or 7 wherein fore and aft movement of the stick control member controls movement of the reversing buckets in unison and thereby controls forward and reverse thrust on the boat.

9. The boat of claim 2, wherein the first direction of movement of the stick control member is fore and aft movement of the member, and wherein the control circuit is configured so that movement of the stick control member forward from a neutral position moves the buckets in unison toward a forward thrust position, and movement of the stick control member rearward from a neutral position moves the buckets in unison toward a reverse thrust position.

10. The boat of claim 2, wherein the second direction of movement of the stick control member is rotation about a generally vertical axis, and wherein the control circuit is configured so that rotation of the stick control member produces rotation of the nozzles in unison.

11. The boat of claim 2, wherein the third direction of movement of the stick control member is left and right sideward movement, and wherein the control circuitry is configured so that leftward movement of the stick control member produces rotation of the boat about a vertical axis in a direction that produces leftward movement of the bow of the boat, and rightward movement of the stick control member products rotation of the boat about a vertical axis in a direction that produces rightward movement of the bow of the boat.

12. The boat of claim 2, wherein the first direction of movement of the stick control member is fore and aft movement of the member, and wherein the control circuit is configured so that movement of the stick control member forward from a neutral position moves the buckets in unison toward a forward thrust position, and movement of the stick control member rearward from a neutral position moves the buckets in unison toward a reverse thrust position;

the second direction of movement of the stick control member is rotation about a generally vertical axis, and wherein the control circuit is configured so that rotation of the stick control member produces rotation of the nozzles in unison and the left or right sideward forces on the stern; and the third direction of movement of the stick control member is left and right sideward movement, and wherein the control circuitry is configured so that leftward movement of the stick control member produces rotation of the boat about a vertical axis in a direction that produces leftward movement of the bow of the boat, and rightward movement of the stick control member rotation of the boat about a vertical axis in a direction that produces rightward movement of the bow of the boat.

13. The boat of claim 12 wherein the stick control member and control circuit are configured to provide at least two modes of operation, a first mode in which a followup relationship exists between forward/aft movement of the stick control member, and up/down unison movements of the reversing buckets, and a second mode in which a non-follow-up relationship exists between forward/aft movement of the stick control member and up/down unison movements of the reversing buckets.

14. The boat of claim 12 wherein the stick control member and control circuit are configured to provide a follow-up relationship between the rotation of the stick control member and rotation of the nozzles.

15. The boat of claim 12 wherein the control circuit is configured to provide both a docking mode and a power steer mode of operation, wherein in the docking mode of operation, the reversing buckets and the nozzles have a follow-up relationship to the respective movements of the stick control member, and wherein in the power steer mode of operation, the reversing buckets have a non-followup relationship and the nozzles have a followup relationship to the respective movements of the stick control member.

16. The boat of claim 2 wherein the stick control member and control circuit are configured so that, in at least one mode of operation, when the operator releases the stick member it returns to a neutral position and all forward and reverse forces, all sideward forces on the stern, and all torque about a vertical axis are brought substantially to zero.

17. The boat of claim 1 wherein the boat is 75 feet or under in length.

* * * * *

UNITED STATES PATENT AND TRADEMARK OFFICE

CERTIFICATE OF CORRECTION

PATENT NO. : 6,386,930 B2
DATED : May 14, 2002
INVENTOR(S) : David W. Moffet

It is certified that error appears in the above-identified patent and that said Letters Patent is hereby corrected as shown below:

Column 2,
Line 42, after "two" insert -- waterjets together for control purposes, so that the buckets of both jets are always at the same --.

Column 8,
Line 56, after "member" insert -- produces --.

Signed and Sealed this

Fifth Day of November, 2002

*Attest:*

*Attesting Officer*

JAMES E. ROGAN
*Director of the United States Patent and Trademark Office*